United States Patent [19]

Johnson et al.

[11] Patent Number: 5,016,056

[45] Date of Patent: May 14, 1991

[54] MULTICOLOR IMAGE FORMING APPARATUS AND TRANSFER ROLLER

[75] Inventors: Kevin M. Johnson, Rochester; Robert E. Zeman, Webster, both of N.Y.

[73] Assignee: Eastman Kodak Company, Rochester, N.Y.

[21] Appl. No.: 519,999

[22] Filed: May 7, 1990

[51] Int. Cl.[5] ..... G03G 15/00

[52] U.S. Cl. ..... 355/279; 355/272; 355/326

[58] Field of Search ..... 355/279, 326, 327, 328, 355/272, 271, 73, 282, 285; 101/177, 246, 409

[56] References Cited

U.S. PATENT DOCUMENTS

| | | | |
|---|---|---|---|
| 3,612,677 | 10/1971 | Langdon et al. | 355/326 |
| 3,633,543 | 1/1972 | Pitasi et al. | 355/272 X |
| 3,702,482 | 11/1972 | Dolcimascolo et al. | 355/272 X |
| 4,127,265 | 11/1978 | Wirz et al. | 101/409 X |
| 4,416,531 | 11/1983 | Mayer | 355/272 X |
| 4,712,906 | 12/1987 | Bothmer et al. | 355/3 TR |
| 4,766,463 | 8/1988 | Watanuki et al. | 355/272 |
| 4,875,069 | 10/1989 | Takada et al. | 355/326 X |
| 4,914,737 | 4/1990 | Amemiya et al. | 355/326 X |
| 4,937,635 | 6/1990 | Paxon et al. | 355/326 |
| 4,949,129 | 8/1990 | Folkes et al. | 355/326 X |

FOREIGN PATENT DOCUMENTS

| | | | |
|---|---|---|---|
| 1-179181 | 7/1989 | Japan | 355/279 |

*Primary Examiner*—R. L. Moses

*Attorney, Agent, or Firm*—Leonard W. Treash, Jr.

[57] ABSTRACT

Multicolor electrophotographic apparatus secures the ends of a receiving sheet in a trough which runs parallel to the axis of rotation of a transfer roller. An inclined surface in the trough gradually declines the transfer sheet away from the periphery of the transfer roller to prevent a photoconductive drum from receiving a jar as it rides off the edge of the transfer sheet. Preferably, the means defining the declining ramp surface also defines vacuum holes for securing the ends of the receiving sheet.

12 Claims, 3 Drawing Sheets

MULTICOLOR IMAGE FORMING APPARATUS AND TRANSFER ROLLER

FIELD OF THE INVENTION

This invention relates to the formation of multicolor toner images of the type formed in electrophotography and similar processes. More specifically, this invention relates to a multicolor image forming apparatus having a transfer roller particularly adapted to very high quality superposition of color toner images.

BACKGROUND ART

In conventional color electrophotography, a series of electrostatic images are created on an image member. For example, a charged photoconductive drum is imagewise exposed with an electronic flash, an electronic printhead or optical scanner. The electrostatic images are toned with different colors to create a series of different color toner images. The toner images are then transferred in registration to a receiving sheet which is repeatedly presented to the image member. Conventionally, the receiving sheet is fixed to the periphery of a transfer roller which engages the image member and rotates the receiving sheet repeatedly into transfer relation with the images as they are presented.

As dry toners are successfully made smaller, higher and higher quality images can be formed on the image member.

Transfer of color images made up of extremely fine toner particles appears to be considerably more difficult than transfer with more coarse toner. Ordinary electrostatic transfer has not proven as effective as has transfer involving a combination of pressure and heat. Pressures in excess of 40 pounds per square inch, preferably pressures substantially in excess of 100 pounds per square inch, have been found to be effective in transferring small particle toners which have been heated to either their softening or sintering point. Although such a transfer process is effective with ordinary paper receivers, it is especially effective with paper receivers with a surface coating of a heat softenable thermoplastic. The heat softenable thermoplastic is heated to its softening point which in turn heats the toner in the nip between the receiving sheet and the image member. The toner softens or sinters and portions of it embed in the thermoplastic material while other portions cling to the toner so embedded. This process is most effective with much higher pressures than those used in conventional color electrophotography.

Utilizing the resolutions available with small particle toners requires high resolution in the image forming process. Typically, such high resolution is obtained with an electronic or optical scanning device which scans an image onto a uniformly charged photoconductive periphery of a drum. Any mechanical discontinuity in the rotation of the photoconductive drum can affect the scanning accuracy and show up in the image.

DISCLOSURE OF THE INVENTION

It is an object of the invention to provide a multicolor toner image forming apparatus, generally of the electrophotographic type described in which mechanical discontinuities to the rotation and position of the photoconductive drum that may be imparted by a transfer roller in pressure contact with it are lessened.

This and other objects are accomplished by a multicolor image forming apparatus having a photoconductive drum and a transfer roller in pressure engagement as in the prior art. However, the transfer roller has a trough in its peripheral surface running generally parallel to its axis. A receiving sheet is secured to the periphery of the drum by securing the ends in the trough. The trough includes means defining a ramp surface for supporting a secured end of the receiving sheet through a gradual decline away from the periphery of the drum.

With such a transfer roller, substantial pressures can be maintained between the roller and the photoconductive drum with substantially reduced impact to the drum when the drum rides off the end of a receiving sheet. With such a structure, a smooth transition from contact between the receiving sheet and the photoconductive drum and no such contact is made thereby lessening a source of a mechanical jar to the drum that can adversely affect the scanning operation.

According to a preferred embodiment, timing of image creation can be controlled according to the effective circumference of the transfer roller (circumference with the receiving sheet). Use of the invention improves the consistency of that circumference because the circumference is not affected by skew of the sheet or varying length of the sheet.

According to a preferred embodiment, the means which defines the ramp surface also defines a vacuum hole leading to such surface for securing the end of the receiving sheet to the transfer roller.

According to a further preferred embodiment, the transfer roller has outer roller portions outside of a central portion which central portion includes the trough. The outer roller portions ride on the photoconductive drum when the trough is facing the drum. These outer roller portions are only slightly less large in diameter than the roller supported receiving sheet and therefore also reduce the effect of the photoconductive drum riding off and on the transfer sheet. If these outer portions are correctly sized they will prevent toner transfer to the roller and contact between the image member and the central portion when no sheet is present. This latter advantage is useful in case of paper jam, misfeed or the like.

DESCRIPTION OF THE PREFERRED EMBODIMENTS

Figure 1:
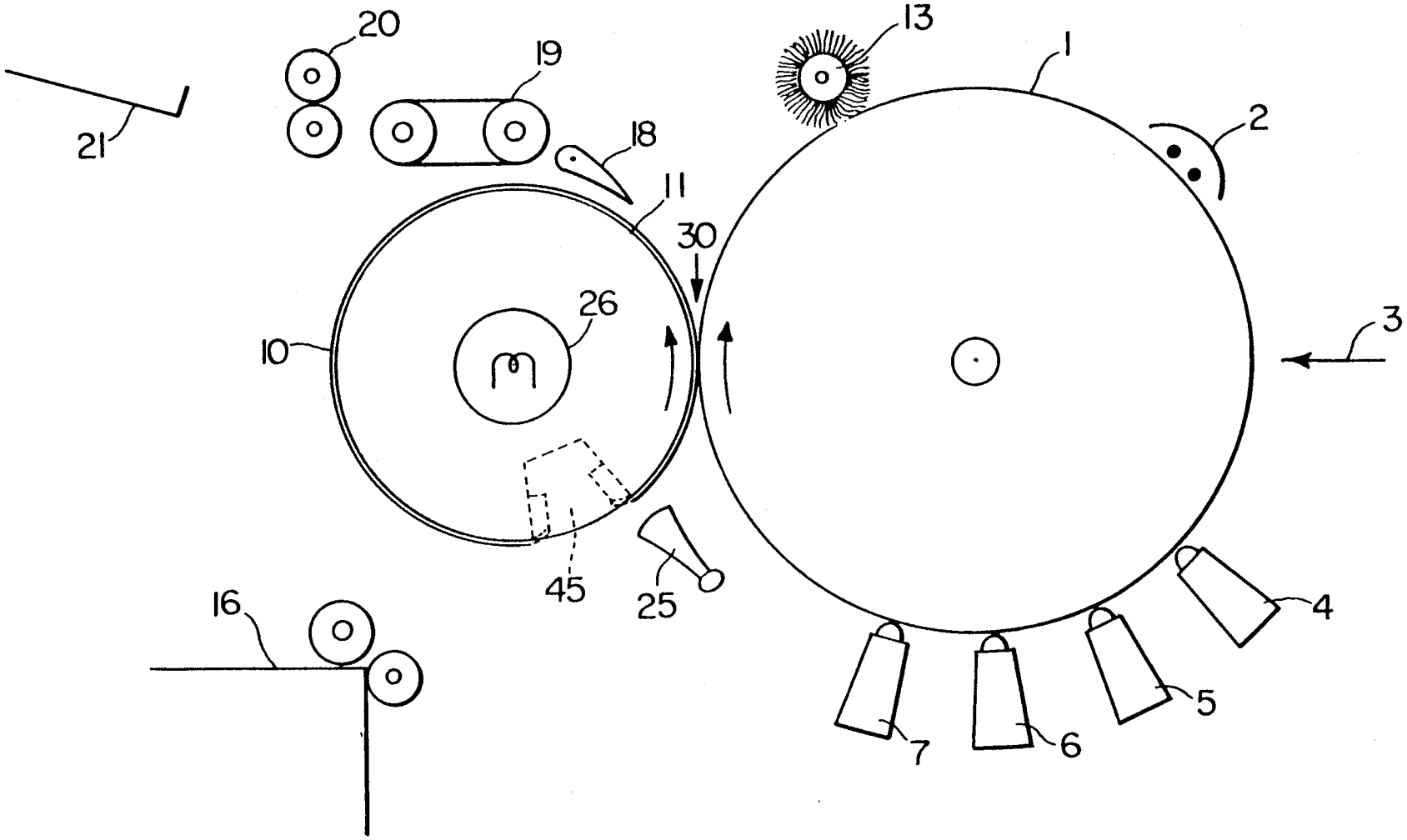
FIG. 1 is a side schematic of an electrophotographic printer constructed according to the invention.

According to FIG. 1, a conventional multicolor electrophotographic apparatus includes an image member, for example a photoconductive drum 1, which is rotatable past a series of stations. The drum 1 is first uniformly charged at a charging station 2, then imagewise exposed at an exposure station, for example laser exposure station 3, to create a series of electrostatic images. The images are toned with toners of different color at toning stations 4, 5, 6 and 7 to create a series of different color toner images. The color toner images are transferred in registration to a receiving sheet 10 which is carried on the periphery of a transfer roller 11 to form a multicolor image thereon. The periphery of photoconductive drum 1 is then cleaned at a cleaning station 13 for reuse. The receiving sheet 10 has been fed to transfer roller 11 from a sheet supply 16. After the multicolor image has been formed it is separated from drum 11 by separating means 18 and transported by a transporting device 19 to a fuser 20 and hence to a output tray, all of which is conventional in the art.

With extremely fine toners, for example toners as small as 3.5 microns and smaller, extremely high resolution multicolor images are obtainable on receiving sheet 10. Transfer of such images is best effected by a combination of heat and pressure in a nip 30 between transfer roller 11 and photoconductive drum 1. For example, the receiving sheet 10 can be externally heated by an external heat source 25 just prior to entering the nip. Alternative to or in addition to external heat source 25, the drum may be heated internally by a conventional heating lamp 26. Relatively high pressures in nip 30, along with good heat transfer, can best be obtained if both transfer roller 1 and roller 11 are hard rollers, for example, aluminum rollers without even hard rubber or other somewhat compliant material on their surface. Alternatively, one or both of the rollers can be slightly compliant to allow some width of the nip for heat transfer. We have found the best results are obtained if both rollers are hard.

With substantial pressure applied between two hard rotating members, the smoothness of movement of drum 1 is dependent in part upon the smoothness of the contact between it and roller 11. The edges of the receiving sheet constitute a discontinuity in that contact. Thus, a leading or trailing end of a receiving sheet passing through the drum-roller nip can jar the photoconductive drum 1. That is, the photoconductive drum 1 essentially falls off or rides upon the edge of the receiving sheet and impacts the roller, jarring the drum 1. Since no image is being transferred at this time, this is not of great consequence to the transfer process. However, it is not convenient to control the process so that no image is being exposed at that time. If an image is being exposed, this jar can be of enough consequence to result in a visible defect in the final multicolor image due to a variation in the exposure, for example, a discontinuity in the middle of a scan. At the very least, it can cause a large torque spike requiring a stronger and more elaborate drive system to overcome it. Although this condition can affect an optical exposure or an LED printhead exposure, it appears to be more serious with extremely high quality laser exposure where the jar can occur in the middle of a scan of a line.

Figure 2:
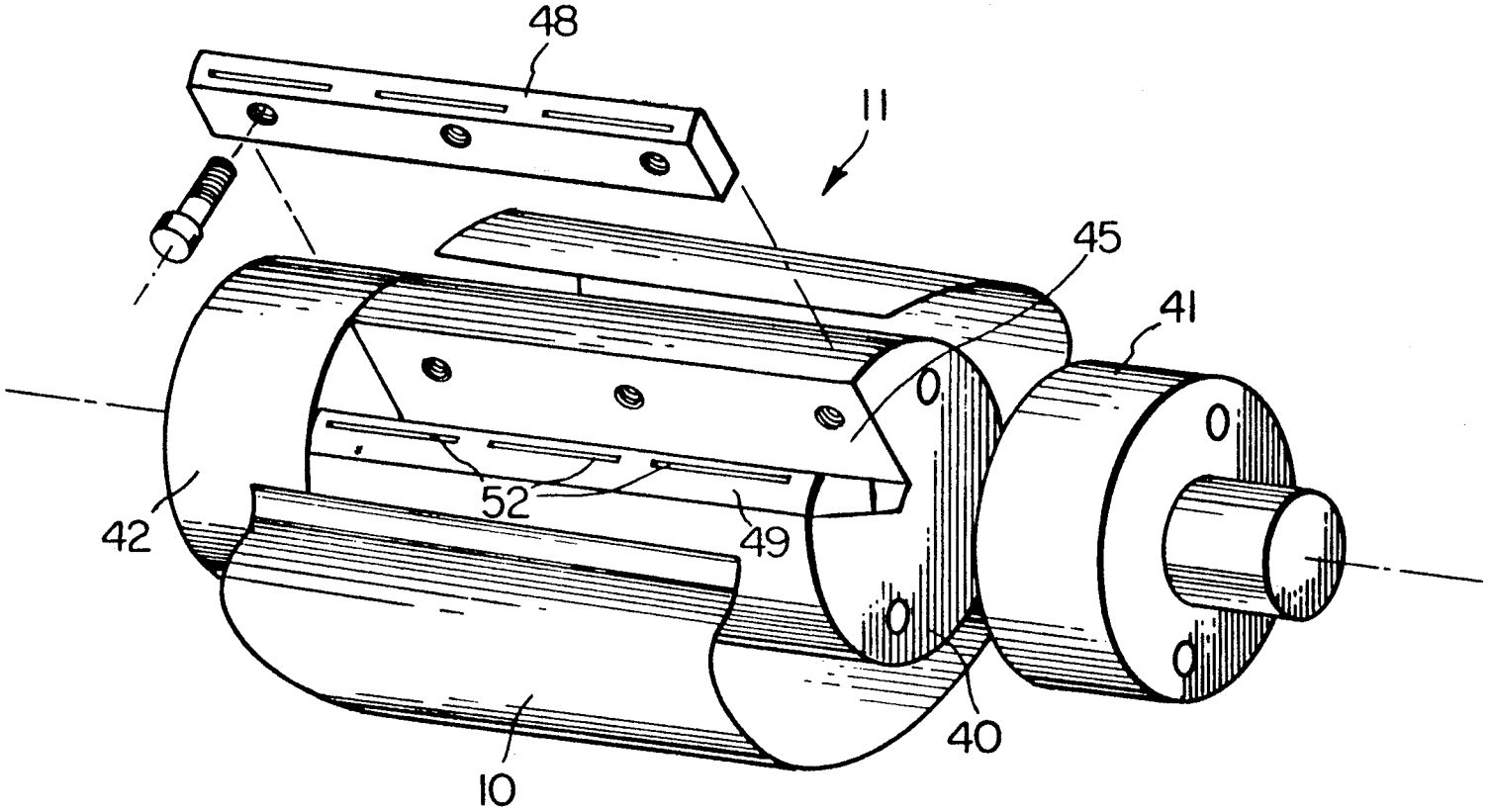
FIG. 2 is a perspective view of a transfer roller shown in FIG. 1 with portions exploded for clarity of illustration.
Figure 3:
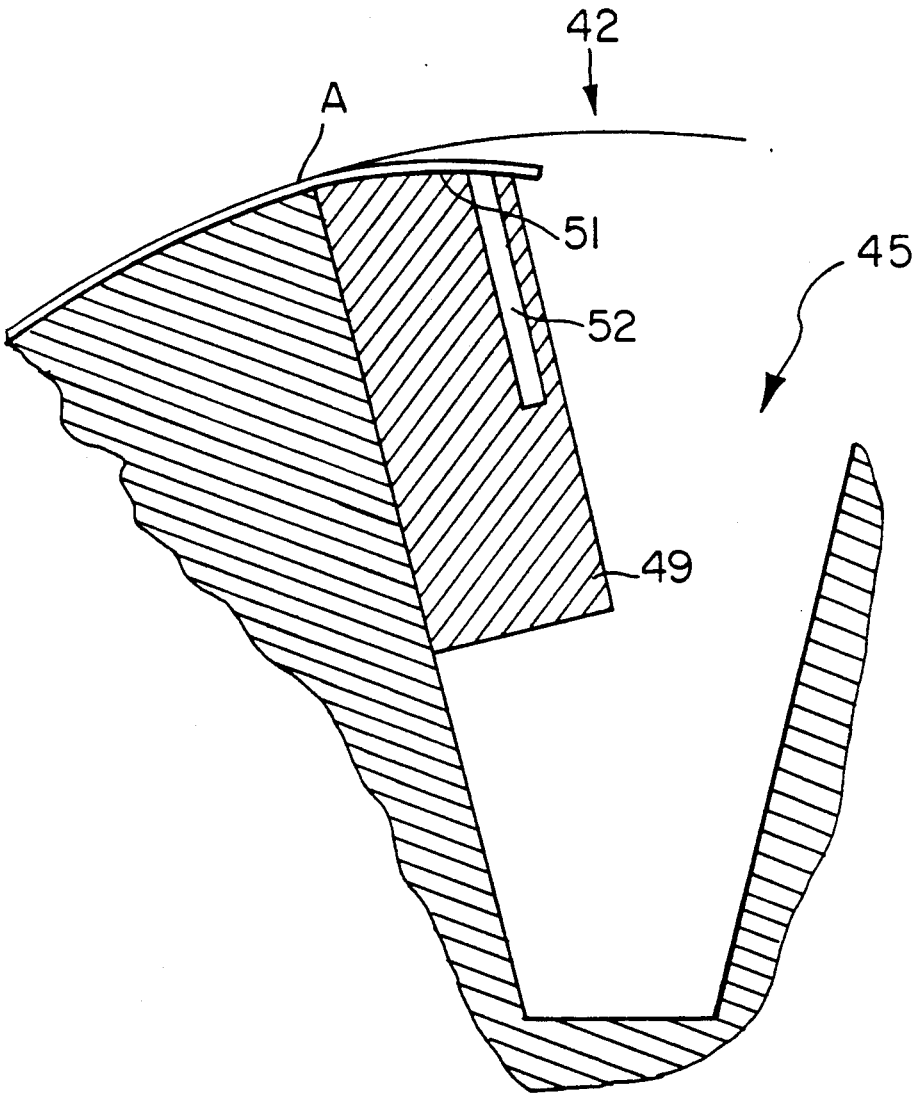
FIG. 3 is a cross-section of a trough portion of the transfer roller shown in FIGS. 1 and 2.

The solution to this problem is best illustrated in FIGS. 2–3 which show in more detail the transfer roller 11. According to FIG. 2, transfer roller 11 is made up of three parts, a central portion 40 and two outer or end portions 41 and 42. The end portions 41 and 42 are bolted or otherwise fixed to the center portion 40. The center portion 40 has a trough 45 running generally parallel to its axis of rotation. A pair of vacuum drop-off bars 48 and 49 are secured to radial surfaces defining the trough 45. They could also be integrally formed out of the same material as the rest of the center portion 40. The vacuum drop-off bar 49 is shown in cross-section in FIG. 3 with a portion of roller 11. The top of the vacuum drop-off bar defines a ramp surface 51 and vacuum holes 52. Vacuum holes 52 are connected to a source of vacuum by means not shown.

End roller portions 41 and 42 are slightly larger in diameter than the central roller portion 40. Ideally, end roller portions 41 and 42 have a radius equal to the radius of central portion 40 plus the thickness of the paper at its maximum compression during transfer. However, some tolerances are required in such a system. Therefore, end roller portions are slightly smaller than such a dimension.

In operation, the ends of the paper 10 are secured to vacuum holes 52 on inclined ramp surfaces 51 on each of vacuum drop-off bars 48 and 49. While the receiving sheet 10 is in the nip 30, the pressure in the nip compresses the paper slightly until the surface of the paper approximates or is slightly above the surfaces of roller end portions 41 and 42. When transfer of a single image is finished, further rotation of the drum and roller reach a point A, shown in FIG. 3, which is the intersection of the trailing edge vacuum drop-off bar 49 and the main portion of the periphery of center portion 40. At this point A, the receiving sheet 10 inclines away from a continuation of the periphery of central portion 40 allowing the photoconductive drum to gradually move toward end portions 41 and 42. Ideally this is an extremely short distance, but it is accomplished smoothly without a substantial jar to the photoconductive drum 1. After the trough 45 has passed through the nip 30, the procedure is reversed with the photoconductive drum engaging outer portions 41 and 42 and gradually engaging and compressing the receiving sheet 10 as it emerges from the trough on the ramp surface on vacuum drop-off bar 48.

In a tolerance free system, the outer portions 41 and 42 are exactly the diameter of the center portion 40 and the compressed paper, so that the distance between the roller 11 and the drum 1 does not change at the ends of the receiving sheet. Even in this theoretical situation, the act of compressing the receiving sheet and allowing it to decompress involves work done by the drum 1, which affects its motion. In actual practice, the diameter of the outer portions 41 and 42 is forced by tolerances to be slightly less than that of the compressed sheet. Thus, in addition to compressing the paper the drum and roller are changing separation slightly. The inclined surface 51 causes the change in position and the compression and decompression of the paper to be gradual enough that its effect on the final print is not visible.

The invention has its most useful application in very high resolution systems using laser or LED printheads or optical scanners. However, it has other advantages that make its use potentially more general, for example, with flash exposure systems.

The use of the end roller portions 41 and 42 and/or the trough 45 provide a consistent circumference to the transfer roller-receiver sheet combination. That is, a slight skew in the receiving sheet or slight difference in the length of the receiving sheet will change that circumference if the sheet is held to a continuous roller periphery and the image drum rides down to a shorter roller radius and back up. With the structure shown in the Figs., the ends of the sheets are not a factor in determining the circumference and the effective radius is closer to constant. This consistent circumference is useful in very high quality registration in which the circumference of the transfer roller-receiving sheet combination or its relation to the circumference or rotation of the image member is monitored to control exposure, for example, flash exposure or start of scan.

The end roller portions 41 and 42 also prevent contact between the roller and the image portion of the drum if there is no sheet in the nip. This can occur when there is a paper misfeed or jam or during intentional non-imaging running. Since the preferred transfer roller surface is a hard material, for example, aluminum, this prevents damage to the image portion of drum 1. It also prevents transfer of toner from the image drum in absence of paper, leaving toner on the drum where it can more easily be cleaned off by cleaning station 13.

The invention has been described in detail with particular reference to a preferred embodiment thereof, but it will be understood that variations and modifications can be effected within the spirit and scope of the invention as described hereinabove and as defined in the appended claims.

We claim:

1. Multicolor image forming apparatus comprising a photoconductive drum rotatable to bring a photoconductive periphery of said drum past a series of electrophotographic stations, which stations include charging, exposing and toning stations to create a series of different color toner images, and a transfer station for transferring said images in registration to a receiving sheet to create a multicolor toner image, said transfer station including:

a rotatable transfer roller forming a pressure nip with said drum and having an axis of rotation, a peripheral surface, and a trough in said peripheral surface running generally parallel to said axis, means for securing a receiving sheet to said periphery, said means including means located in said trough for securing an end of a receiving sheet, and means defining a ramp surface in said trough for supporting said secured end through a gradual decline away from an extension of the periphery of said roller as the end enters the trough.

2. Apparatus according to claim 1 wherein said means defining a ramp surface also defines vacuum holes for securing said end of said receiving sheet to said roller.

3. Apparatus according to claim 1 wherein said exposing means includes means for incrementally scanning an image onto said photoconductive surface and said decline is sufficiently gradual that the passage of the trough through said pressure nip does not perceptively affect said scanning.

4. Apparatus according to claim 1 further including means for holding the other end of said sheet in said trough and means defining a ramp surface for supporting said secured other end through a gradual decline away from said extension of the periphery of said roller.

5. Apparatus according to claim 1 further including means for heating said receiving sheet while secured to said roller.

6. Apparatus according to claim 5 wherein said means for heating includes means for heating a heat softenable outer layer of said receiving sheet.

7. Apparatus according to claim 1 wherein said roller and said drum form a nip with a pressure of at least 40 pounds per square inch.

8. Apparatus according to claim 1 wherein said roller has a central portion and two outer portions, the central portion having said trough and the outer portions having a diameter greater than the central portion but less than the diameter of the central portion and a sheet secured to the peripheral surface, said outer portions being positioned to engage said drum when said trough is passing through said pressure nip.

9. Apparatus according to claim 1 wherein said roller has a central portion and two outer portions arranged on opposite sides of said central portion on said axis, said outer portions being fixed to said central portion for rotation therewith, said central portion having said trough and said outer portions having a diameter smaller than the combined diameter of said central portion and a secured receiving sheet and being positioned to engage said drum when said trough is passing through said pressure nip.

10. Multicolor image forming apparatus comprising a drum rotatable to bring its periphery past a series of stations which form a series of different color toner images thereon, and a transfer station for transferring said series of toner images in registration to a receiving sheet to create a multicolor image, said transfer station comprising:

a rotatable transfer roller having a central portion and two outer portions fixed to opposite sides of said central portion for rotation therewith, means for securing a receiving sheet around part of said central portion, said outer portions having a diameter larger than said central portion without a receiving sheet but smaller than the combined diameter of said central portion and a secured receiving sheet and being positioned to engage said drum when part of said central portion not having a receiving sheet is passing through said nip.

11. A transfer roller having a peripheral surface, an axis of rotation, and a trough in said peripheral surface running generally parallel to said axis, means located in said trough for securing an end of a receiving sheet to secure said sheet around said surface, and means defining a ramp surface in said trough for supporting a secured end through a gradual decline away from said surface into said trough.

12. A transfer roller having a central portion and two outer portions fixed to opposite sides of said central portion for rotation therewith, means for securing a receiving sheet around part of said central portion, said outer portion having a diameter larger than said central portion without a receiving sheet but smaller than the combined diameter of said central portion and a secured receiving sheet.

* * * * *